US007963842B2

(12) United States Patent
Ruymann

(10) Patent No.: US 7,963,842 B2
(45) Date of Patent: Jun. 21, 2011

(54) GAMING SYSTEM, GAMING DEVICE, AND METHOD FOR PROVIDING A PLAYER AN OPPORTUNITY TO WIN AN ADDITIONAL AWARD AMOUNT

(75) Inventor: Robert W. Ruymann, Reno, NV (US)

(73) Assignee: IGT, Reno, NV (US)

( * ) Notice: Subject to any disclaimer, the term of this patent is extended or adjusted under 35 U.S.C. 154(b) by 888 days.

(21) Appl. No.: 11/876,294

(22) Filed: Oct. 22, 2007

(65) Prior Publication Data

US 2009/0104979 A1 Apr. 23, 2009

(51) Int. Cl.
*A63F 9/24* (2006.01)

(52) U.S. Cl. ..... 463/20

(58) Field of Classification Search ..... 463/20, 463/16

See application file for complete search history.

(56) References Cited

U.S. PATENT DOCUMENTS

| | | | | |
|---|---|---|---|---|
| 5,505,461 | A | 4/1996 | Bell et al. | |
| 6,173,955 | B1 * | 1/2001 | Perrie et al. | 273/146 |
| 6,308,953 | B1 | 10/2001 | Nagano | |
| 6,312,333 | B1 * | 11/2001 | Acres | 463/25 |
| 6,375,187 | B1 | 4/2002 | Baerlocher | |
| 6,454,651 | B1 | 9/2002 | Yoseloff | |
| 6,494,785 | B1 | 12/2002 | Gerrard et al. | |
| 6,506,118 | B1 | 1/2003 | Baerlocher et al. | |
| 6,514,141 | B1 | 2/2003 | Kaminkow et al. | |
| 6,569,015 | B1 | 5/2003 | Baerlocher et al. | |
| 6,599,192 | B1 | 7/2003 | Baerlocher et al. | |
| 6,632,141 | B2 | 10/2003 | Webb et al. | |
| 6,648,754 | B2 | 11/2003 | Baerlocher et al. | |
| 6,692,355 | B2 | 2/2004 | Baerlocher et al. | |
| 6,719,632 | B2 | 4/2004 | Palmer et al. | |
| 6,722,981 | B2 | 4/2004 | Kaminkow et al. | |
| 6,722,982 | B2 | 4/2004 | Kaminkow et al. | |
| 6,758,750 | B2 | 7/2004 | Baerlocher et al. | |
| 6,786,820 | B2 | 9/2004 | Gerrard et al. | |
| 6,793,579 | B2 | 9/2004 | Baerlocher et al. | |
| 6,796,905 | B2 | 9/2004 | Baerlocher et al. | |
| 6,808,452 | B2 | 10/2004 | Baerlocher et al. | |
| 6,808,454 | B2 | 10/2004 | Gerrard et al. | |
| 6,811,483 | B1 | 11/2004 | Webb et al. | |
| 6,852,030 | B2 | 2/2005 | Baerlocher et al. | |
| 6,857,961 | B2 | 2/2005 | Soltys et al. | |
| 6,890,257 | B2 | 5/2005 | Baerlocher | |
| 6,899,623 | B2 | 5/2005 | Baerlocher | |
| 6,942,566 | B2 | 9/2005 | Baerlocher et al. | |
| 6,942,567 | B2 | 9/2005 | Baerlocher et al. | |

(Continued)

FOREIGN PATENT DOCUMENTS

| | | |
|---|---|---|
| EP | 1544813 | 6/2005 |

(Continued)

*Primary Examiner* — David L Lewis
*Assistant Examiner* — Omkar Deodhar
(74) *Attorney, Agent, or Firm* — K&L Gates LLP

(57) ABSTRACT

The gaming system, gaming device, and method provide a player a chance to win a tax award amount upon the occurrence of a game event that is associated with an award amount meeting or exceeding a tax threshold amount. The tax threshold amount can be an amount which, if won, triggers reporting and/or withholding requirements of a federal, state, or local government or other taxing authority. The occurrence of the game event can qualify the player to participate in a second part of the game in which a portion of the award amount is risked and the tax award amount can be won.

16 Claims, 16 Drawing Sheets

U.S. PATENT DOCUMENTS

| | | | | |
|---|---|---|---|---|
| 6,960,132 | B2 | 11/2005 | Baerlocher et al. | |
| 6,966,833 | B2 | 11/2005 | Kaminkow et al. | |
| 6,971,953 | B2 | 12/2005 | Gerrard et al. | |
| 6,984,175 | B2 | 1/2006 | Nguyen et al. | |
| 6,991,544 | B2 | 1/2006 | Soltys et al. | |
| 7,001,273 | B2 | 2/2006 | Baerlocher | |
| 7,004,466 | B2 | 2/2006 | Gauselmann | |
| 7,025,674 | B2 | 4/2006 | Adams et al. | |
| 7,040,984 | B2 | 5/2006 | Mead | |
| 7,160,186 | B2 | 1/2007 | Cuddy et al. | |
| 7,192,349 | B2 | 3/2007 | Baerlocher et al. | |
| 7,235,010 | B2 | 6/2007 | Baerlocher | |
| 7,250,001 | B2 | 7/2007 | Baerlocher et al. | |
| 7,264,545 | B2 | 9/2007 | Maya et al. | |
| 7,270,604 | B2 | 9/2007 | Gerrard et al. | |
| 2001/0051540 | A1 | 12/2001 | Hindman et al. | |
| 2002/0032049 | A1 | 3/2002 | Walker et al. | |
| 2002/0147040 | A1* | 10/2002 | Walker et al. | 463/25 |
| 2003/0013521 | A1 | 1/2003 | Cole et al. | |
| 2003/0040360 | A1 | 2/2003 | Kaminkow | |
| 2003/0078093 | A1 | 4/2003 | Simms et al. | |
| 2003/0083126 | A1 | 5/2003 | Paulsen | |
| 2003/0104862 | A1 | 6/2003 | Acres | |
| 2003/0162584 | A1 | 8/2003 | Hughs-Baird et al. | |
| 2003/0162588 | A1 | 8/2003 | Brosnan et al. | |
| 2004/0010556 | A1 | 1/2004 | Kawakita et al. | |
| 2004/0106444 | A1 | 6/2004 | Cuddy et al. | |
| 2004/0110554 | A1 | 6/2004 | Bromfield | |
| 2004/0162128 | A1 | 8/2004 | Baerlocher et al. | |
| 2005/0020342 | A1 | 1/2005 | Palmer et al. | |
| 2005/0054413 | A1 | 3/2005 | Randall et al. | |
| 2005/0130729 | A1 | 6/2005 | Baerlocher et al. | |
| 2005/0170884 | A1 | 8/2005 | Okada | |
| 2006/0172791 | A1 | 8/2006 | Wolf | |
| 2007/0135206 | A1* | 6/2007 | Inamura | 463/20 |

FOREIGN PATENT DOCUMENTS

| | | |
|---|---|---|
| JP | 2005-168755 | 6/2005 |
| JP | 2005-192991 | 7/2005 |
| WO | WO 00/32286 | 6/2000 |
| WO | WO 02/17251 | 2/2002 |
| WO | WO 03/063019 | 7/2003 |

* cited by examiner

GAMING SYSTEM, GAMING DEVICE, AND METHOD FOR PROVIDING A PLAYER AN OPPORTUNITY TO WIN AN ADDITIONAL AWARD AMOUNT

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Wagering gaming devices are a popular form of entertainment played by millions of players each year. Typically, a player places a wager to play a primary game of a gaming device and hopes for a winning outcome. In such gaming devices, the amount a player may win is based on a pay table of the gaming device. The paytable is typically structured such that several outcomes are associated with the player winning relatively small awards or no awards, fewer outcomes are associated with the player winning relatively medium sized awards, and even fewer outcomes are associated with the player winning relatively larger awards. Many players play gaming devices to try to win such relatively large awards, even though they know that they have a very small chance of winning such relatively large awards.

Typically, if a player is lucky and wins a relatively large award, that player's enjoyment of the game is very high. However, in many instances, when a player wins a relatively large award, a tax withholding and/or reporting requirement is imposed by the federal, state or local government or any other taxing authority. For example, a United States Federal government withholding and/or reporting requirement is imposed when a player wins $1200 or more at a wagering gaming device. Accordingly, if a player is lucky and wins an amount that causes a withholding and/or reporting requirement, the initial excitement of winning may turn to disappointment when the player realizes that they must pay taxes on the entire award amount. This reduces the player's enjoyment of the game and the overall gaming experience. There is a need to address this problem.

SUMMARY

The gaming system, gaming device, and method disclosed herein provide a player with a chance to win a tax award amount upon an occurrence of a game event which results in an award amount meeting or exceeding a tax threshold amount. In one embodiment, the tax threshold amount is an amount which, if won, causes a withholding and/or reporting requirement on the gaming device operator for or to a federal, state, or local government or other taxing authority. In one embodiment, the award amount meeting or exceeding a tax threshold amount qualifies the player to participate in a second part or sequence of the game wherein a portion of that award amount is risked and a tax award amount can be won.

In one embodiment, if the player is eligible to participate in the second part of the game, the gaming device enables the player to elect to participate or to decline participation in the second part of the game. If the player declines or does not elect to participate in the second part of the game, the award amount which meets or exceeds the tax threshold amount is paid to the player subject to the withholding and/or reporting requirement. The payment and reporting may be done manually or automatically.

In one embodiment, if the player elects to participate in the second part of the game, the gaming device determines: (i) the portion of the award amount risked; and (ii) whether the outcome of the second event is a winning or a losing outcome. In another embodiment, if the player elects to participate in the second part of the game, the gaming device: (i) enables the player to determine the portion of the award amount risked (from a range of suitable possible amounts); and (ii) determines whether an outcome of the second event is a winning or a losing outcome.

In these embodiments, if the outcome is a losing outcome, the player wins the award amount determined in the first part of the game minus the portion of the award amount risked in the second part of the game. In one embodiment, the portion of the award amount risked is an excess amount that is greater than the difference between the award amount and the tax threshold amount. (For example, if the first part of the game provides a $1300 win, and the threshold is $1200, the excess amount can be $101.) As a result of the reduction in the award amount determined in the first part of the game, the player wins an award amount less than the tax threshold amount for the play of the game. Accordingly, the reporting and/or withholding requirements are not imposed for this play of the game.

If the outcome of the second event or second part of the game is a winning outcome, the player wins an increased award amount that includes the award amount from the first part of the game (such as $1300 in the above example) plus a tax award amount for the second part of the game. This increased award amount (after an amount is paid by the player from this increased award amount) is, in one embodiment, at least equal to the award amount from the first part of the game. Further elaborating an the above example, the tax award amount may be $500, resulting in a total award of $1800. This takes into account that the player would pay a tax of $325 at a 25% tax payment rate on the $1300. This also takes into account that the player would, because they also won the second part of the game, pay a tax of $450 at a 25% tax payment rate on the combined win of $1800. In this example, after paying the tax, the award to the player is $1350 (i.e., $1800 combined award−$450 tax amount) which is greater than the award of $1300 in the first part of the game. As the player is provided a total award for the play of the game that is at least equal to the award amount associated with the first event, the described configuration reduces the potential for the player to be disappointed due to the tax withholding requirement on the player's winnings.

In one embodiment, the probability of generating a winning outcome in the second part of the game depends on the excess amount (i.e., the portion risked) and the difference between the award amount from the first part of the game and the increased award amount (i.e., the amount to be gained from a winning outcome in the second part of the game). In one embodiment, the excess amount (i.e., the portion risked) is a predetermined amount greater than the difference between the award amount and the tax threshold amount (e.g., 101% of the difference; the difference plus $0.01, $1, $5 or the minimum wager amount for the game; or any other suitable amount). In another embodiment, the gaming device enables the player to select the amount by which the excess amount (i.e., the portion risked) exceeds than the difference between the award amount and the tax threshold amount. In one such embodiment, the gaming device displays the probability of generating a winning outcome in the second part of the game associated with the excess amount the player is considering risking.

In one embodiment, the tax threshold amount is the maximum amount that can be provided to the player for that play of the game without triggering a withholding and/or reporting requirement. It should be appreciated that in alternative embodiments, the processor of the gaming device is operable to receive data representing the tax threshold amount from a remote server or store the tax threshold amount in association with at least one gaming device memory device.

In the above described embodiments, the gaming device determines whether to enable the player to elect to participate in the second part of the game after an award amount that meets or exceeds the tax threshold amount is won or displayed. In an alternative embodiment, the gaming device determines whether to enable the player to elect to participate in the second part of the game before the first event is displayed. For example, before the game is played, the gaming device prompts the player to indicate whether the they wish to proceed with the second part of the game if they win a qualifying award in the first part of the game. In another embodiment, the gaming device requires the player to participate in the second part of the game if the player wins a qualifying award. In another embodiment, the gaming device requires the player to place an additional wager or side bet at the start of the game to qualify for the features described herein.

In one embodiment, the game event enabling the player to participate in the second part of the game is also associated with the award amount being less than an upper threshold. If the award amount is greater than or equal to the upper threshold, the player does not qualify to participate in the second part of the game. As a result, a tax withholding and/or reporting requirement is implemented and the appropriate amount is provided to the player.

Additional features and advantages are described herein, and will be apparent from the following Detailed Description and the Figures.

DETAILED DESCRIPTION

The present disclosure may be implemented in various configurations for gaming machines, gaming devices or, including but not limited to: (1) a dedicated gaming machine, gaming device gaming systems, wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
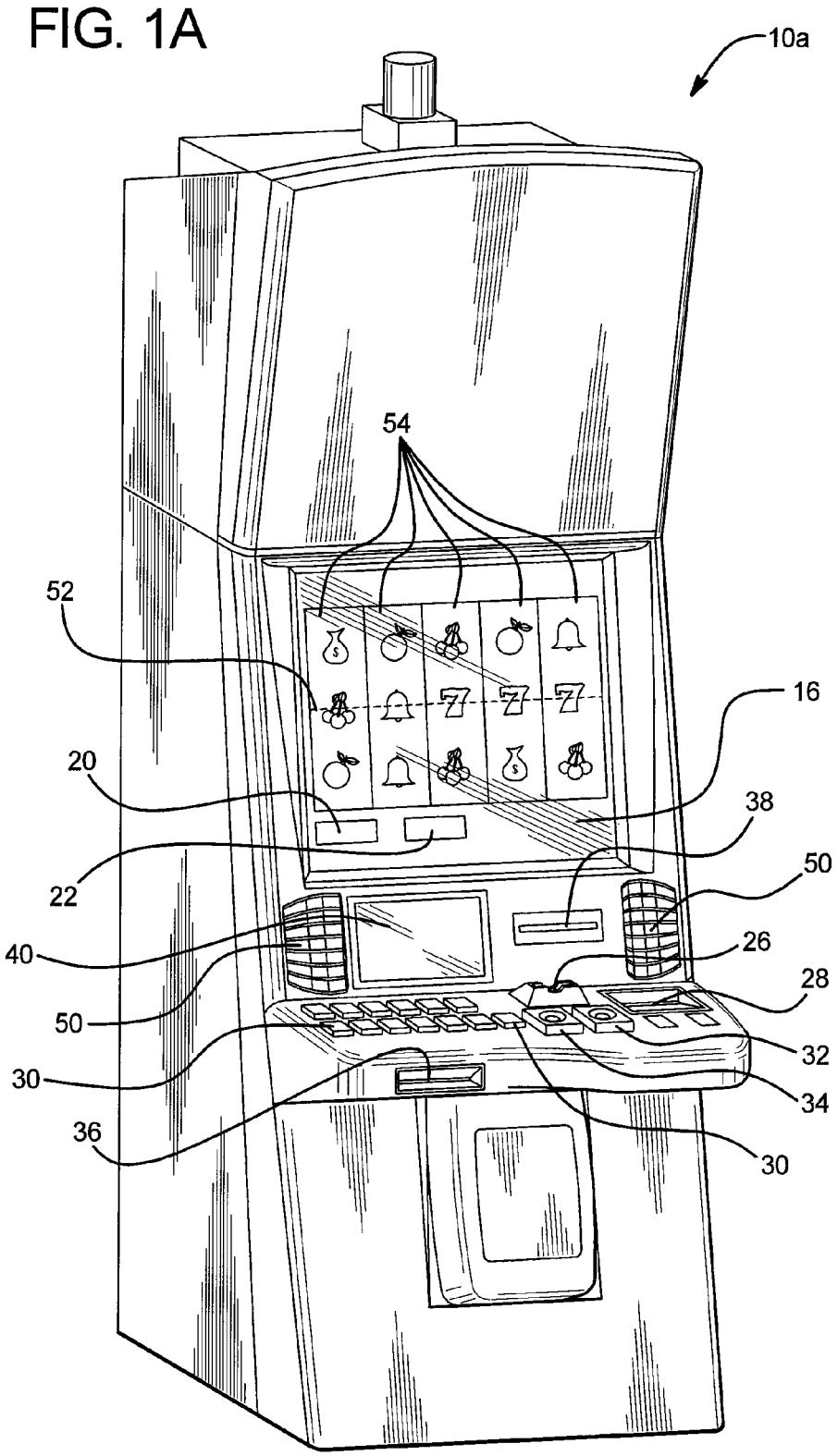
FIGS. 1A and 1B are perspective views of alternative embodiments of a gaming device.
Figure 1B:
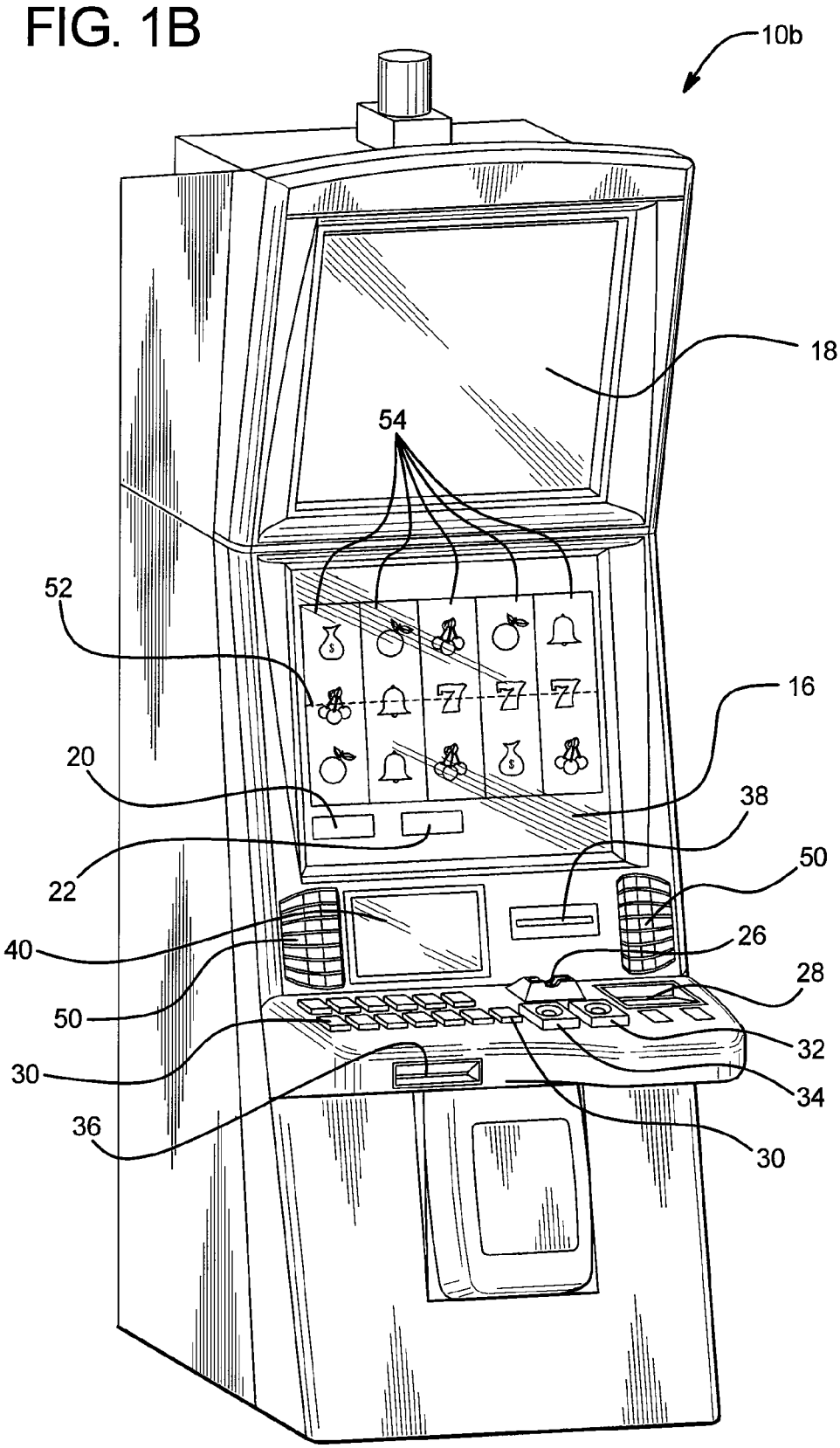

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
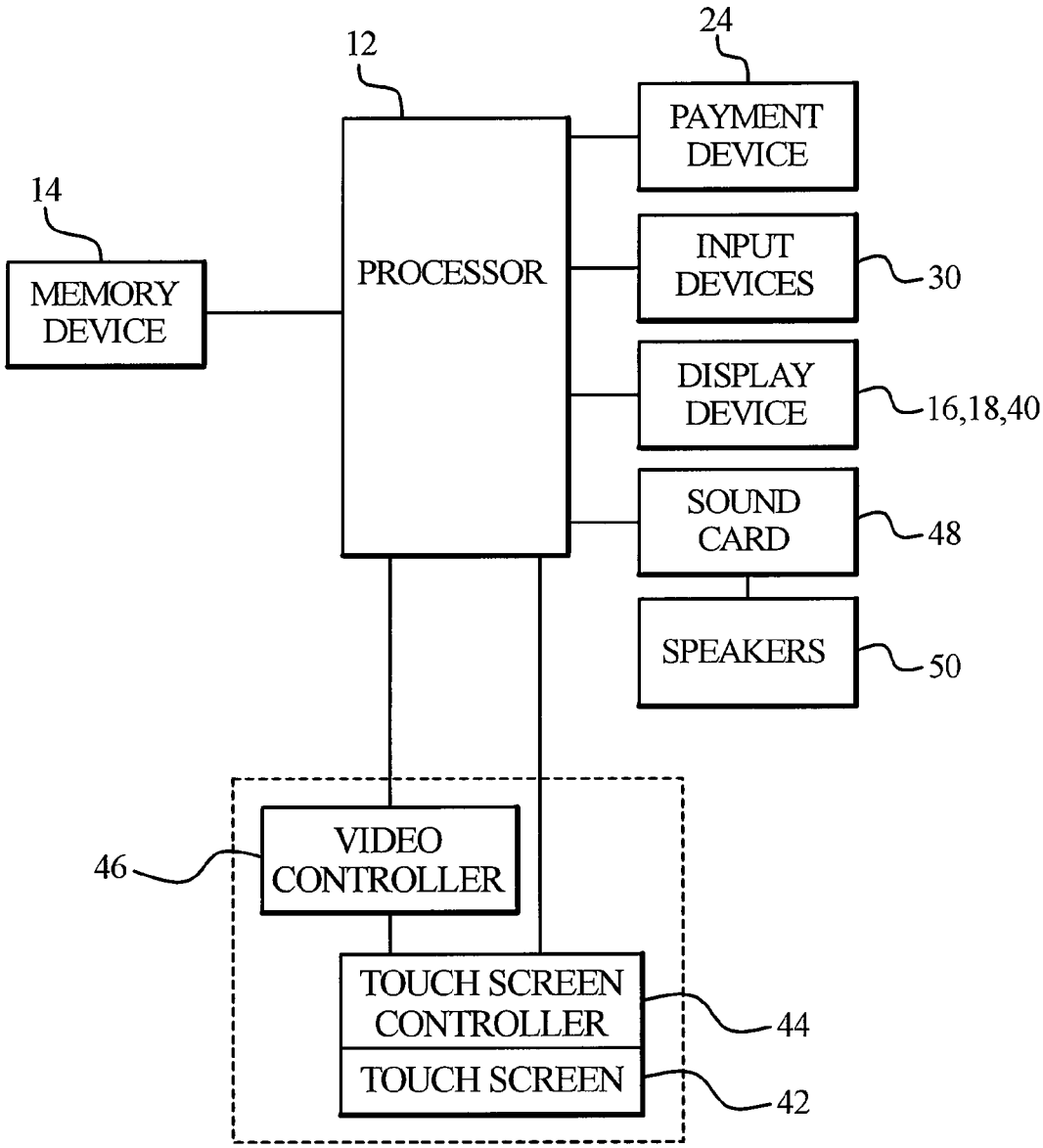
FIG. 2A is a block diagram of a gaming device in accordance with one embodiment.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), portable computing device, or another computerized platform to implement the present disclosure. In one embodiment, the gaming device or gaming machine disclosed herein is operable over a wireless network, for example as part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data), and other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device the enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one, all or of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of two cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
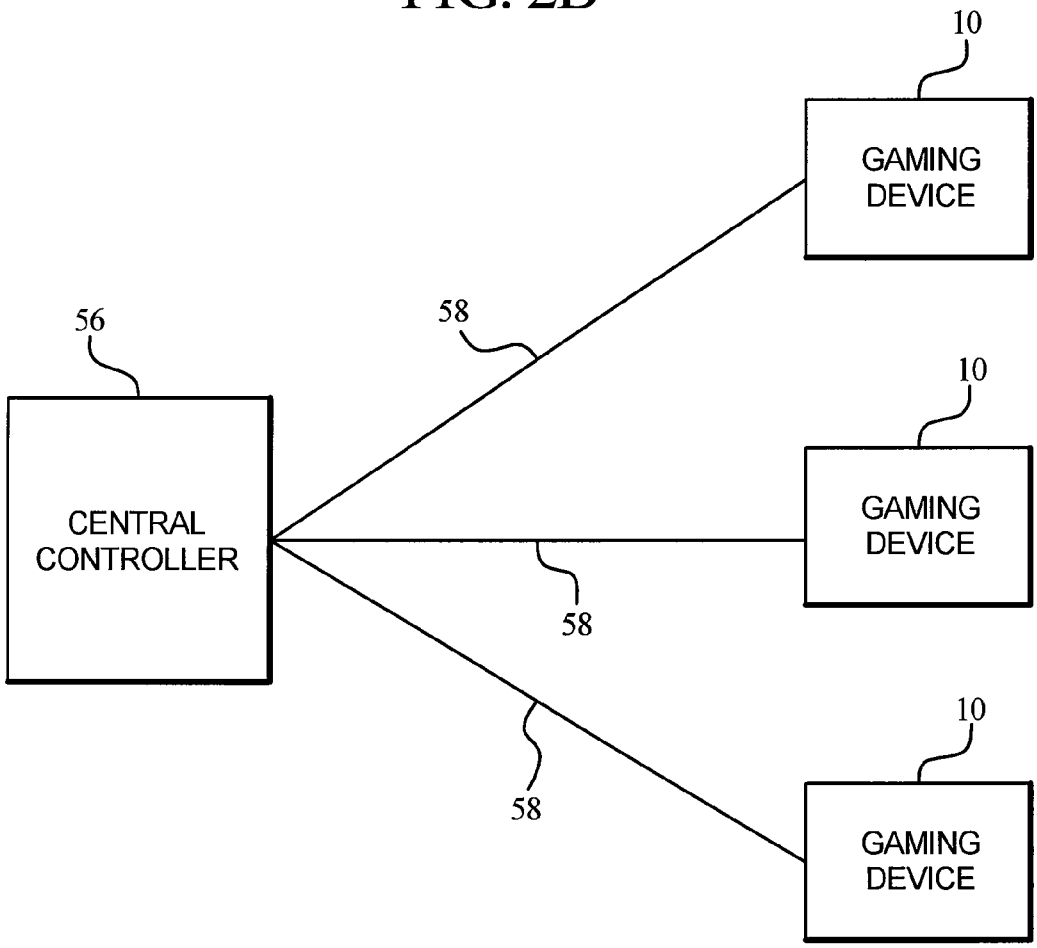
FIG. 2B is a block diagram of a gaming system in accordance with one embodiment.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Providing a Player an Opportunity to Win a Tax Award Amount

Referring now to FIGS. 3A, 3B, 3C, 3D, 3E, 3F, and 3G, one embodiment is illustrated wherein the gaming device provides a game in which the player has a chance to win a tax award amount upon the occurrence of a game event that results in an award amount meeting or exceeding a tax threshold amount. In this illustrated embodiment, the gaming device has an increase wager input 60 and a decrease wager input 62, with which the player can change the wager amount 22. As explained in text area 64 of FIG. 3A, increasing or decreasing the wager amount 22 will also change the number of paylines 52 played on the plurality of reels 54. It should be appreciated that the amounts of wagers by the player and the number of paylines played for a slot game can be inputted by the player in any other suitable manner.

Figure 3A:
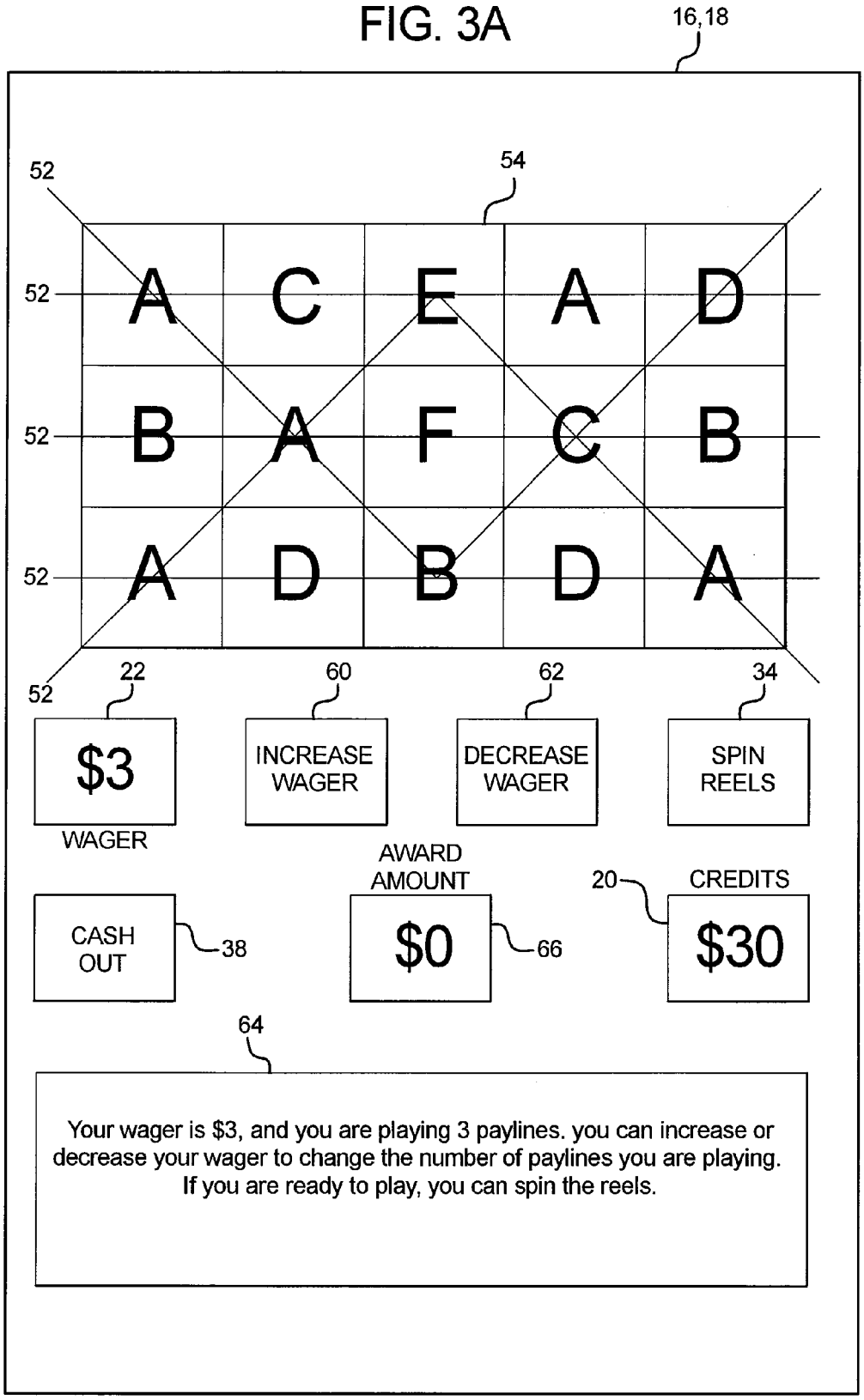
FIGS. 3A through 3G are block diagrams of a display screen in accordance with one embodiment.
Figure 3B:
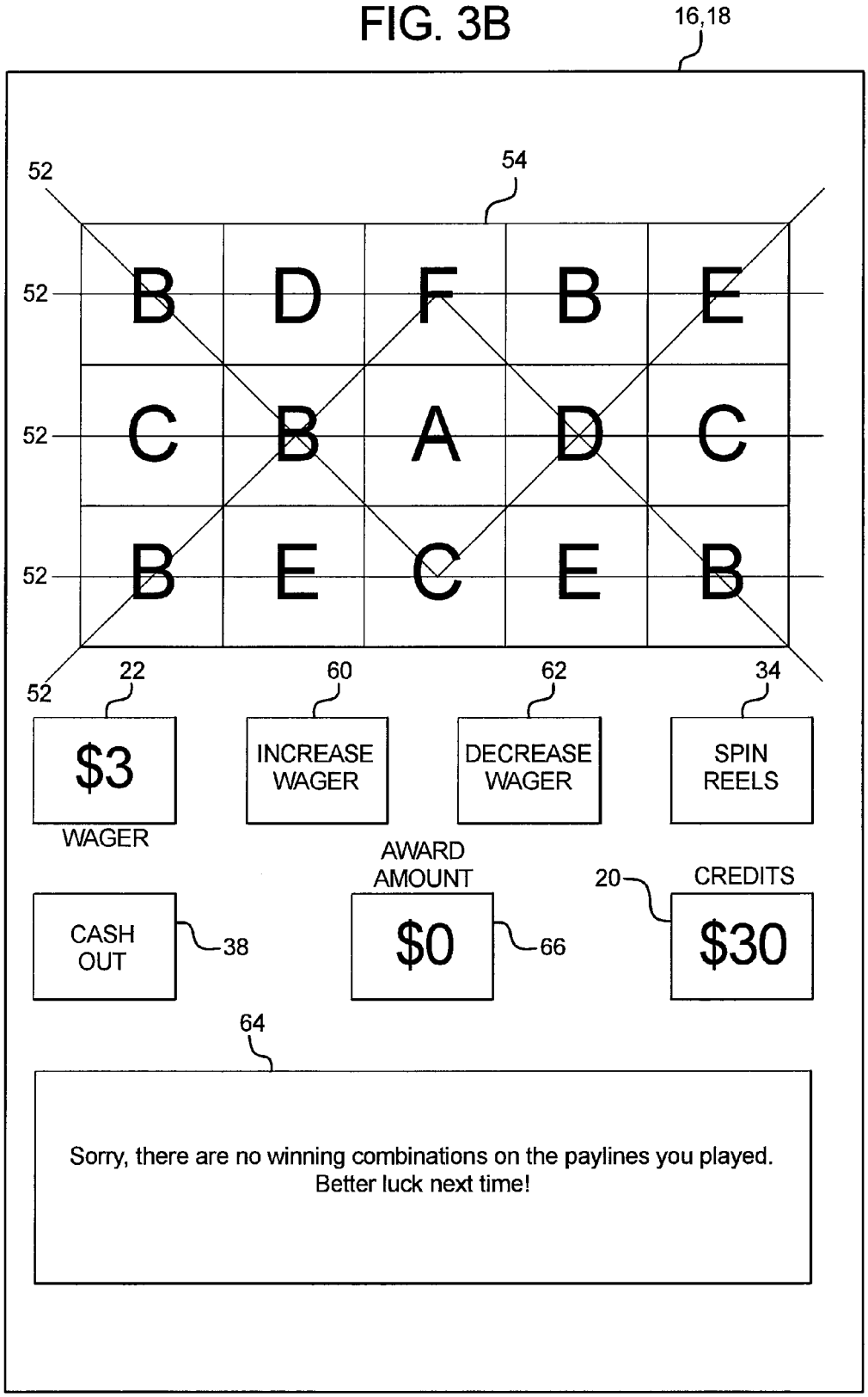
Figure 3C:
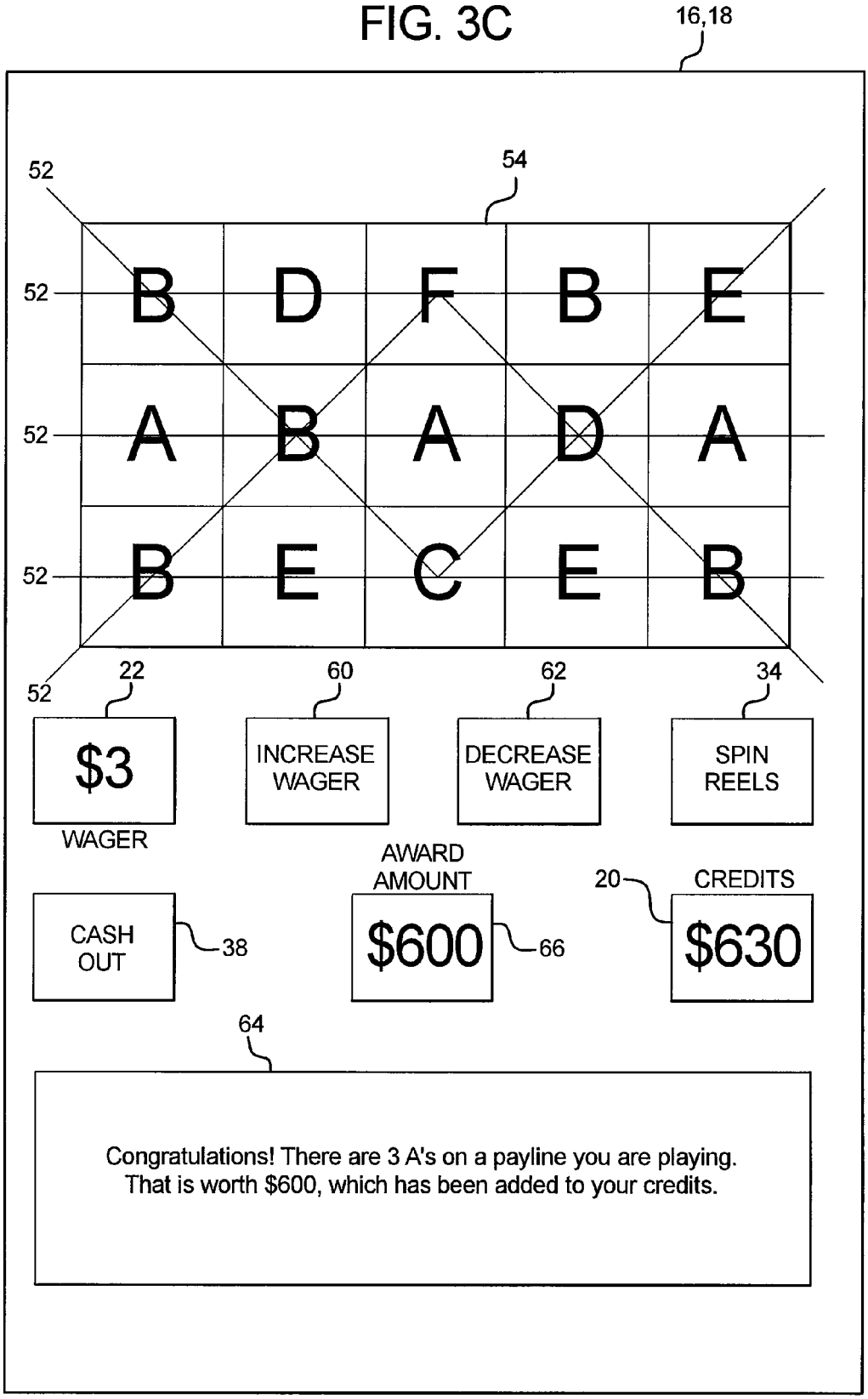

After the player activates the reels 54 by pressing the spin reels input 34, a random outcome is generated on the reels 54. If, as is shown in FIG. 3B, no winning outcome appears on any of the active paylines 54, the award amount 66 is displayed as $0 and text area 64 explains that no winning outcome occurred. If a winning outcome appears on one of the active paylines 52, as shown in FIG. 3C, an award amount associated with the winning outcome is displayed in award amount display area 66.

If the award amount is less than a tax threshold amount, the player wins the award amount and the award amount is added to the player's remaining credits as displayed by credit meter 20. In this example embodiment, the tax threshold amount is an amount which, if paid to the player, would trigger a reporting and/or withholding requirement by a federal, state, or local government or other taxing authority. One example tax threshold amount is $1200 which triggers a United States Federal government withholding and/or reporting requirement. It should be noted that the tax threshold amount may have other values in other embodiments.

Figure 3D:
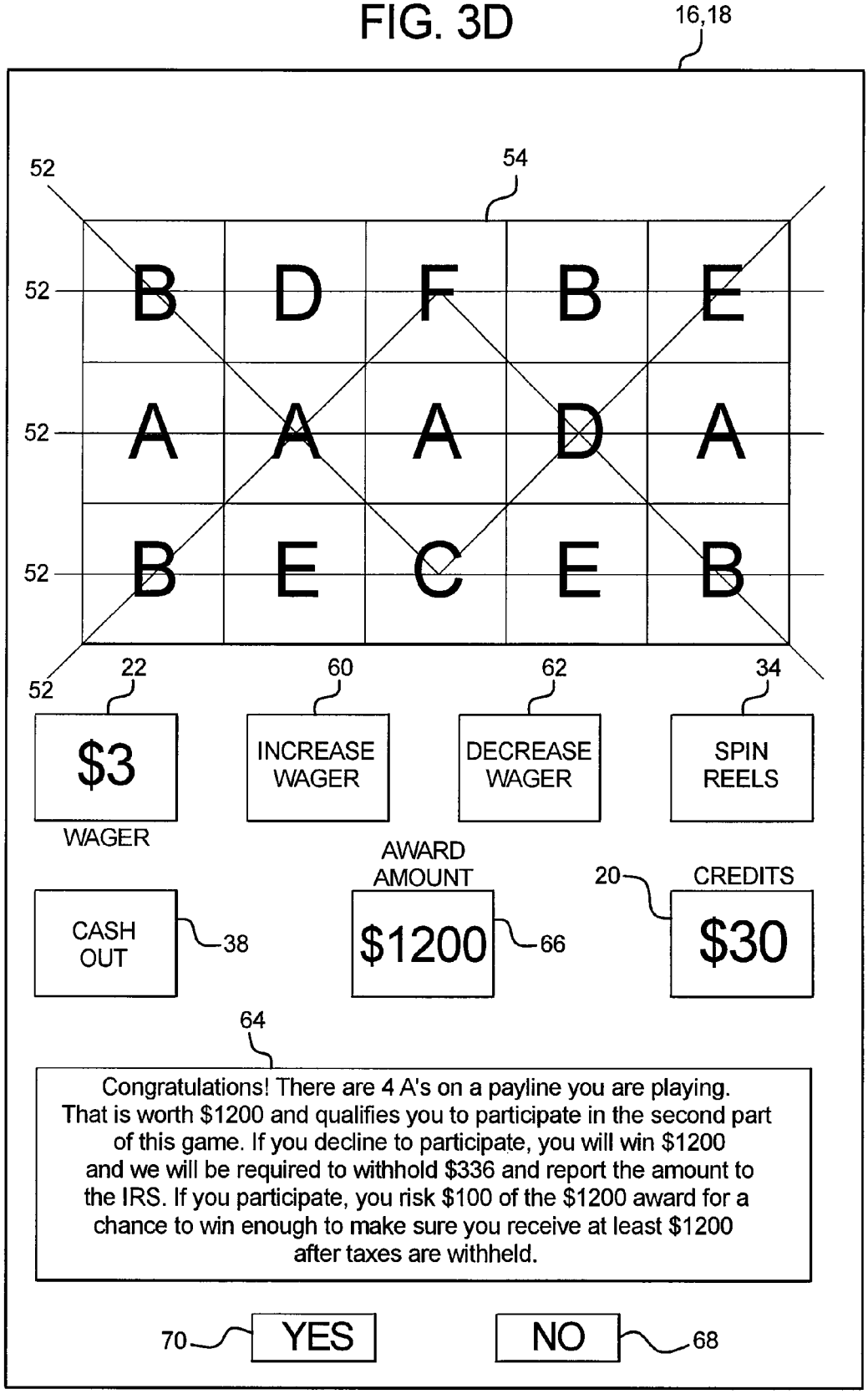

If, as shown in FIG. 3D, the award amount in the first part or sequence of the game is greater than or equal to the tax threshold amount, the player qualifies to participate in a second part or sequence of the game. As explained in text area 64, in the second part of the game, a portion of the award amount can be risked and a tax award amount can be won. As explained below, in various embodiments, the tax award amount is an award amount which satisfies the player's tax obligations on the amount won in the first part of the game. In other embodiments, the tax award amount is an award amount which satisfies part of the player's tax obligations on the amount won in the first part of the game. In other embodiments, the tax award amount is an award amount which satisfies more than the player's tax obligations on the amount won in the first part of the game.

Figure 3E:
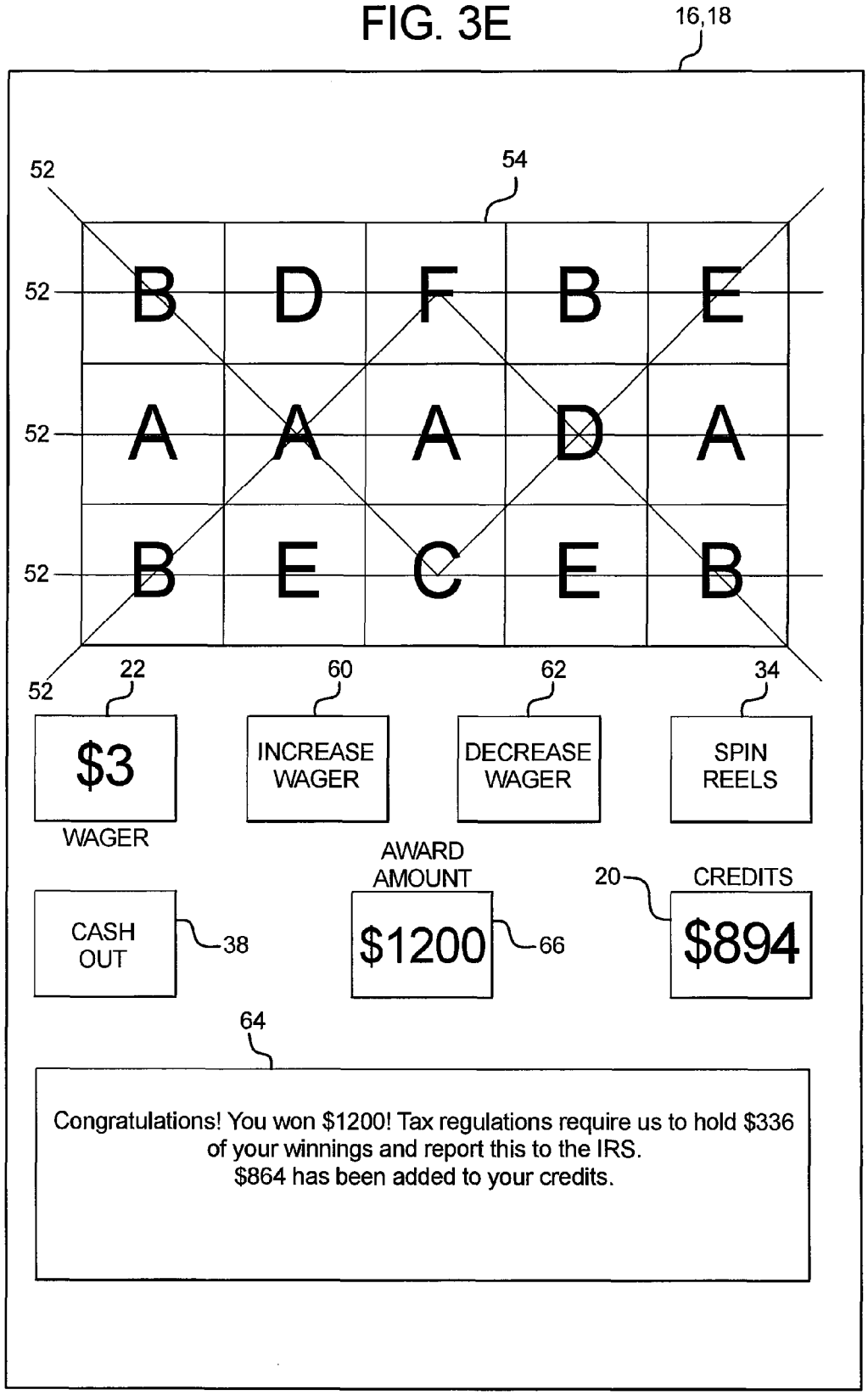

If the player declines to participate in the second part of the game by pressing the "no" input 68, as explained in text area 64 of FIG. 3E, a tax withholding amount of $336 is withheld from the award amount. The remaining amount of $864 is added to the player's remaining credits as displayed by the credit meter 20 in FIG. 3E and the game ends. In this case, the game outcome (i.e., the award amount provided to the player) is reported and to a proper authority, such as the United States Internal Revenue Service. In this illustrated example, the tax amount of $336 is paid to the United States Internal Revenue Service on behalf of the player. In an alternative embodiment not illustrated, the total award of $1200 is paid to the player, the player must pay the tax, and a suitable report regarding the $1200 win is made to the United States Internal Revenue Service.

If the player elects to participate in the second part of the game by pressing the "yes" input 70 (see FIG. 3D), in one embodiment, the gaming device determines the portion of the award amount risked. The gaming device also determines whether an outcome of a second event or part of the game is a winning or a losing outcome. The gaming device displays the determined outcome to the player. In one embodiment, the outcome is randomly determined (e.g., by selection of a random number and comparing the random number to an outcome table) and displayed in second part outcome display area 72. It should be noted that in other embodiments, determining the outcome can include another activation of the reels 54, an activation of a wheel, a play of any game disclosed herein, or any other mechanism or method for randomly determining an outcome.

Figure 3F:
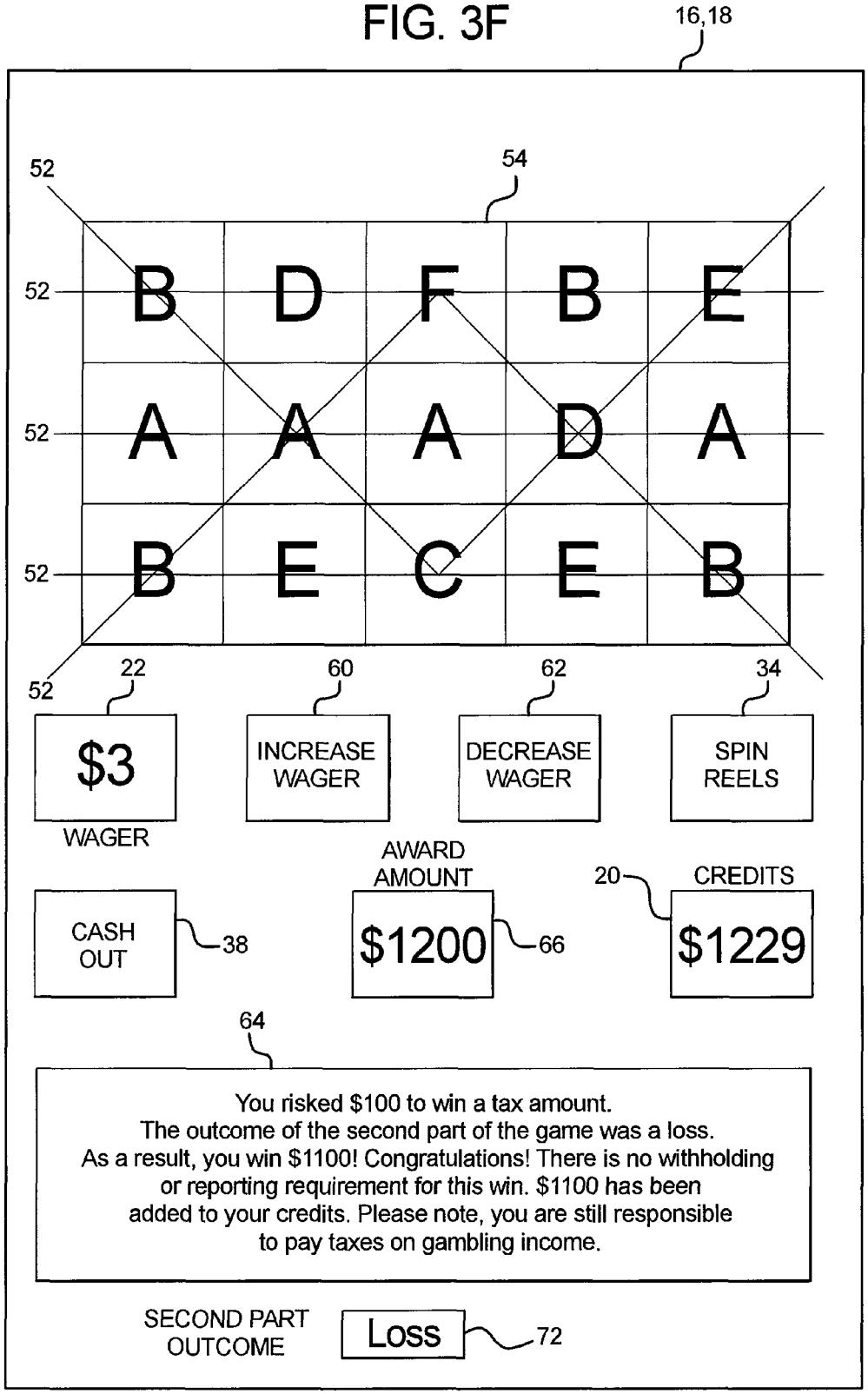

If the outcome of the second part of the game is a losing outcome, as shown in FIG. 3F, the player wins the award amount determined from the first part of the game minus the portion risked in the second part of the game. The portion risked is an excess amount that is at least greater than the difference between the award amount determined from the first part of the game and the tax threshold amount. Specifically, in FIGS. 3D and 3F, $100 of the $1200 award amount is risked. As a result, the player wins a reduced amount of $1100 (which is less than the tax threshold amount of $1200). As explained by text area 64, the withholding and/or reporting requirements are not imposed for the award amount won for this play of the game.

Figure 3G:
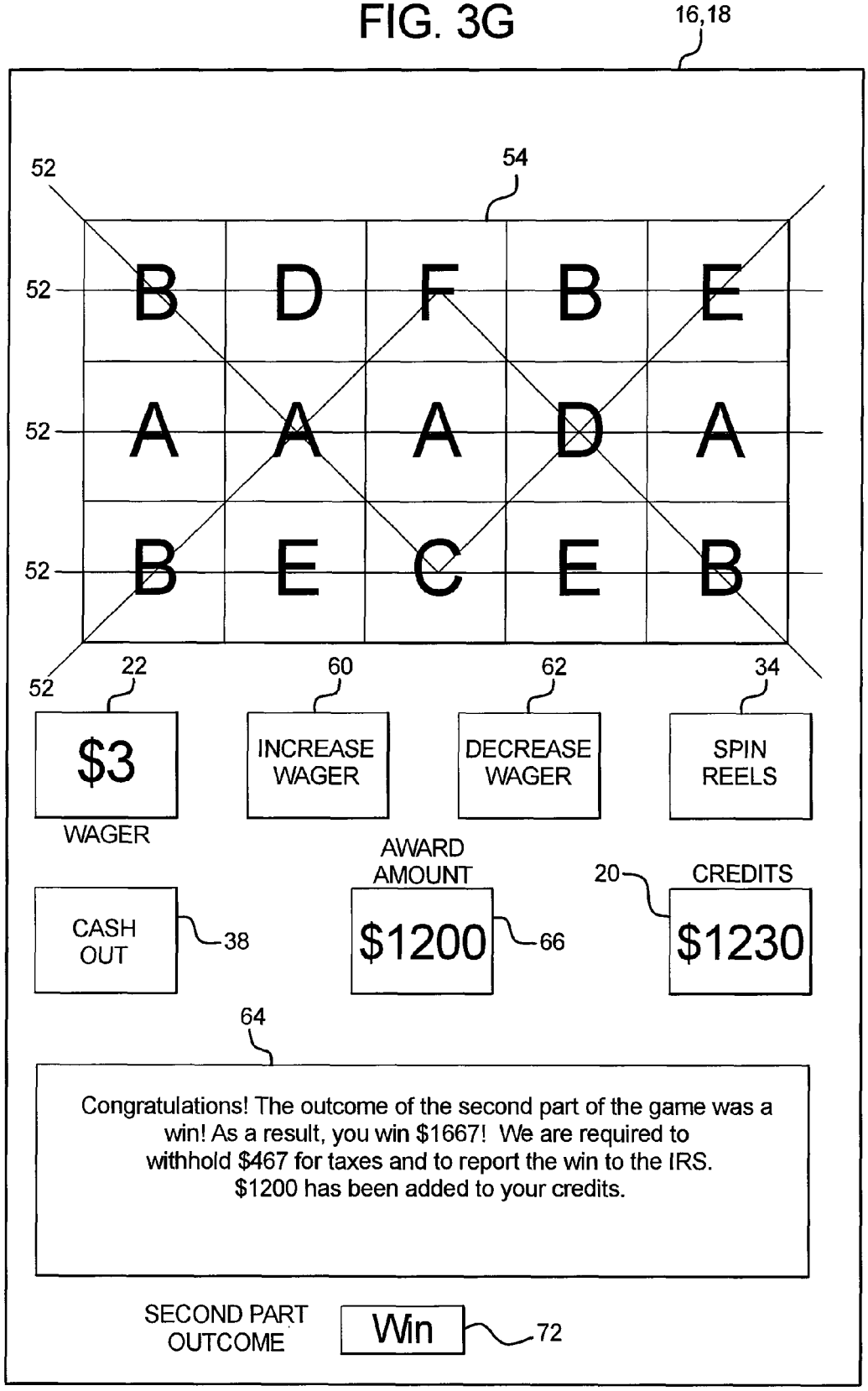

If the outcome of the second part of the game is a winning outcome, as shown in FIG. 3G, the player wins an increased award amount, specifically $1667. The increased award amount includes the award amount of $1200 (from the first part of the game) plus a tax award amount of $467 (from the second part of the game). Of this increased award amount, $1200 is provided to the player and $467 is withheld for payment to the United States Internal Revenue Service along with the report thereto. In an alternative embodiment not illustrated, the total award of $1667 is paid to the player, the player must pay the tax, and a suitable report regarding the $1667 win is made to the United States Internal Revenue Service. It should be appreciated that in these embodiments, the increased award amount minus the amount withheld from the increased award amount (to satisfy the designated withholding tax rate) is at least equal to the award amount from the first part of the game. As a result, the player receives at least the $1200 award amount associated with the first event, which reduces the potential for the player to be disappointed due to taxes to be paid on the player's winnings.

In various embodiments, the probabilities of the outcome (s) from the second part of the game being a winning outcome depends on the excess amount or the portion risked (e.g., $100 in FIGS. 3D, 3F, and 3G) and the difference between the award amount and the increased award amount (e.g., $467). In different embodiments, the excess amount can be determined based on a percentage of the difference between the award amount and the increased award amount (e.g., 101% of the difference), based on the difference plus a set amount, based on a set amount, based on the minimum wager amount for the game, based on an amount sufficient to make the chance of a winning outcome a desired percentage such as 50%, or based on any other suitable predetermined or randomly determined amount. In different embodiments, the excess amount is determined based on a generated symbol or symbol combination, determined based on the player's status (obtained from a player tracking system), determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools, or determined based on any other suitable method or criteria.

Figure 4A:
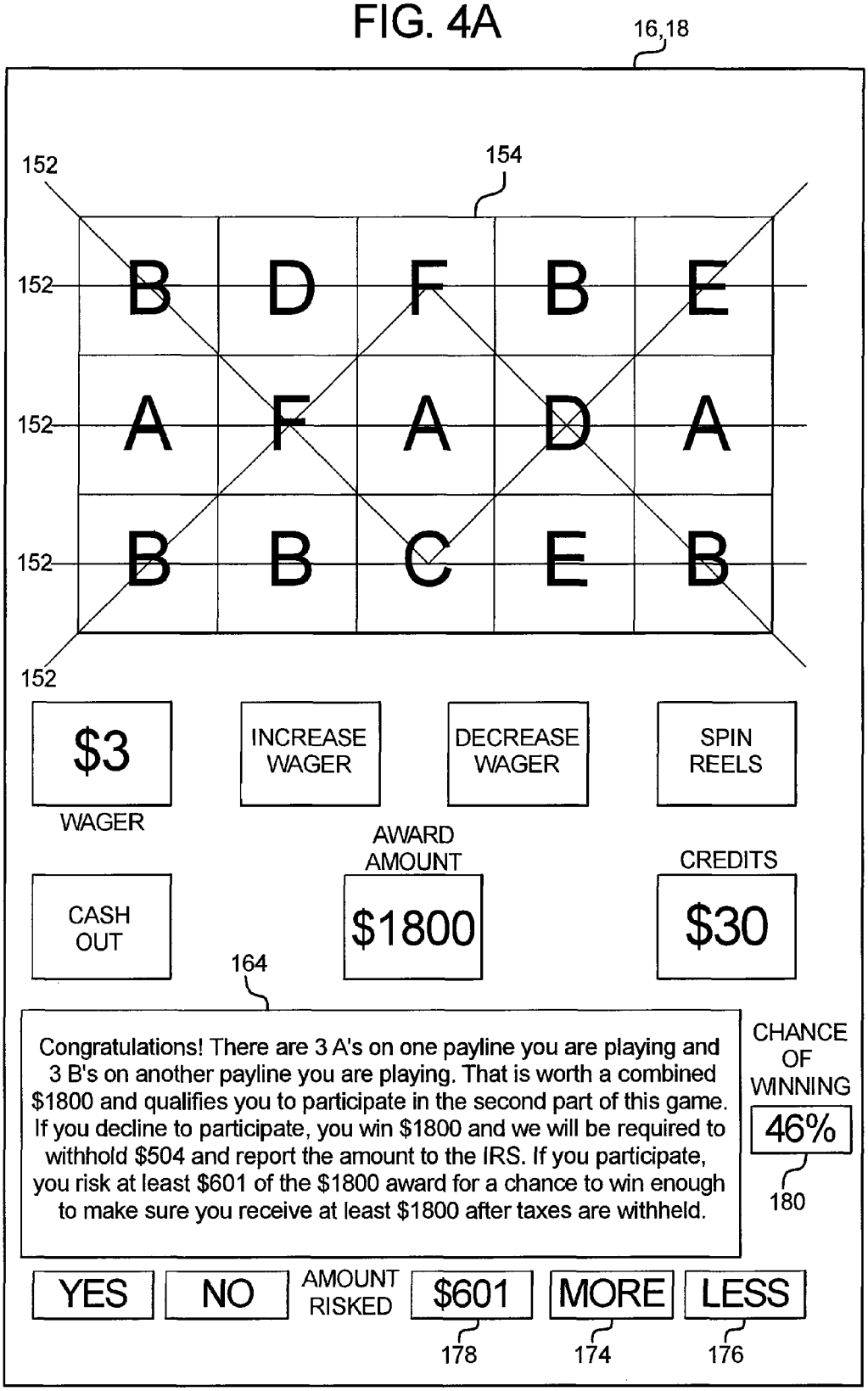
FIGS. 4A and 4B are block diagrams of a display screen in accordance with another embodiment in which a player can adjust the portion of an award amount that is risked in a second part of a game.
Figure 4B:
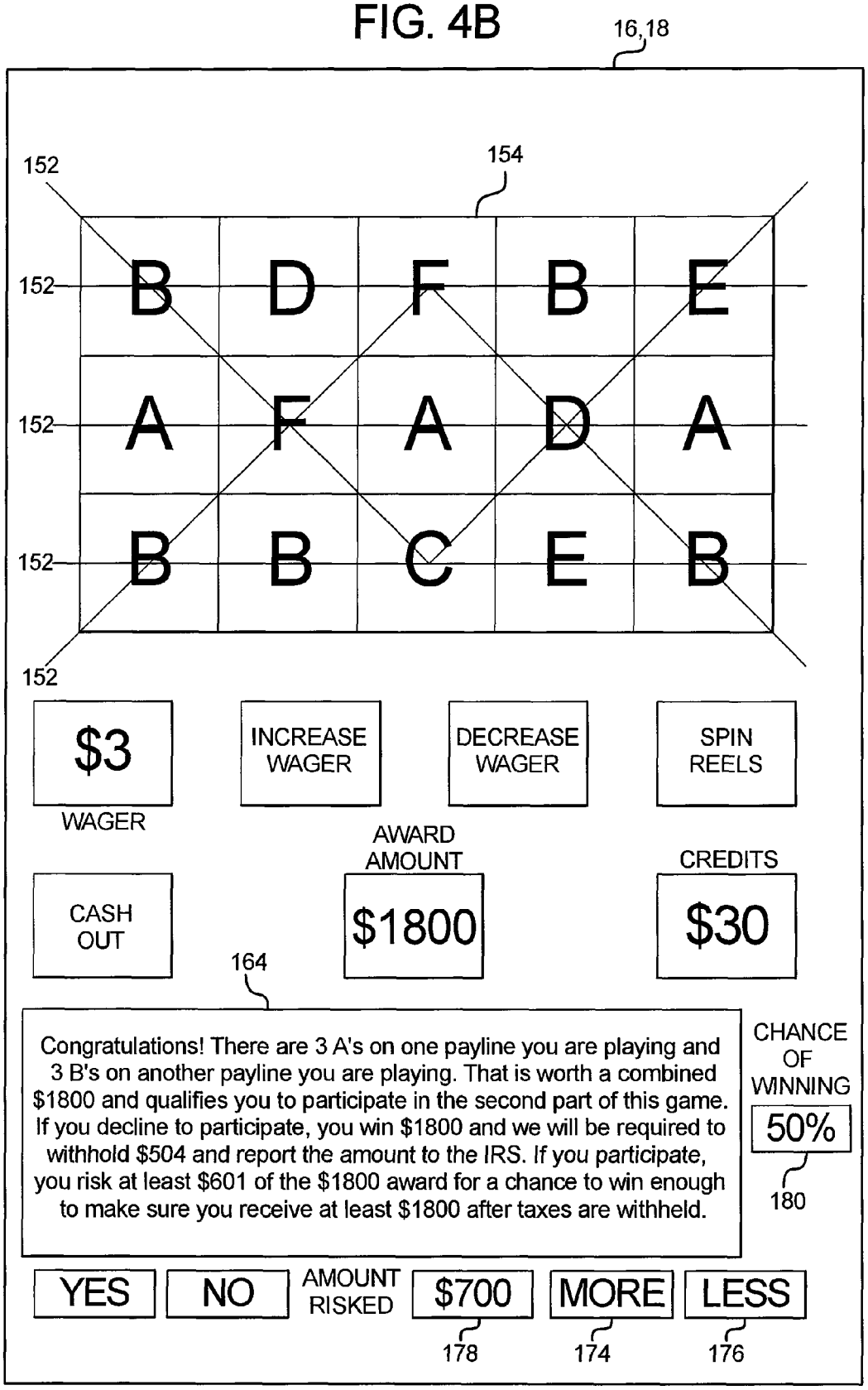

In another embodiment, shown in FIGS. 4A and 4B, the gaming device enables the player to select the amount by which the excess amount or portion risked is greater than the difference between the award amount from the first part of the game and the tax threshold amount. In this embodiment, the player qualified for the second part of the game because the award amount of $1800 from the first part of the game exceeded the tax threshold amount of $1200. As explained by text area 164, if the player elects to participate in the second part of the game, the player must risk at least $601 of the $1800 award amount. In this embodiment, the gaming device enables the player to increase or decrease the amount risked by pressing the more input 174 or the less input 176, respectively.

In one such embodiment, the gaming device does not enable the player to decrease the amount risked below an amount which, when subtracted from the award amount, results in a value less than the tax threshold value. In another embodiment, the gaming device enables the player to decrease the amount risked below such an amount.

The amount risked is displayed in amount risked display area 178, and the corresponding chance or probability of winning is displayed in a chance of winning display area 180. By pressing the more input 174, the player can increase the amount risked to $700, as shown in FIG. 4B. In this case, if the outcome from the second part of the game is a winning outcome, the player wins the award amount of $1800 from the first part of the game plus the tax amount of $700 from the second part of the game for a total of $2500. After $700 is withheld for tax purposes in this example, the gaming device increases the player's credits by $1800 (i.e., the award amount from the first part of the game) and the game ends. As stated above, in alternative embodiments not illustrated, the total award is paid to the player, the player must pay the tax, and a suitable report is provide to the appropriate taxing authority.

In the illustrated embodiment, the chance of winning shown in FIG. 4B is 50% because the amount risked ($700) is equal to the amount the player could gain ($700) from a winning outcome and the expected payout associated with the second part of the game is 100%. In other embodiments, the probabilities of winning can be adjusted to lower the expected payout below 100%. In different embodiments, the chance of generating a winning outcome in the second part of the game is predetermined, randomly determined, determined based on a generated symbol or symbol combination, determined based on the player's status (obtained from a player tracking system), determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools, or determined based on any other suitable method or criteria.

In one embodiment, pressing more input 174 or less input 176 can increment or decrement the amount displayed in amount risked display area 178 without changing the amount displayed in the chance or probability of winning display area 180. In this embodiment, the actual chance or probability of winning is still altered, but the rounded or truncated amount displayed in chance of winning display area 180 remains the same. In another embodiment, the amount displayed in chance of winning display area 180 is the actual chance of winning. In this embodiment, pressing the more input 174 or the less input 176 increments or decrements the amount displayed in amount risked display area 178 by enough to also change the amount displayed in chance of winning display area 180.

In one embodiment, the gaming machine displays a real time total of how much taxes are owed for wins. In one such embodiment, the gaming machine displays multiple a real time total representing the amount of tax that will be paid for wins based on different tax rates.

Figure 5:
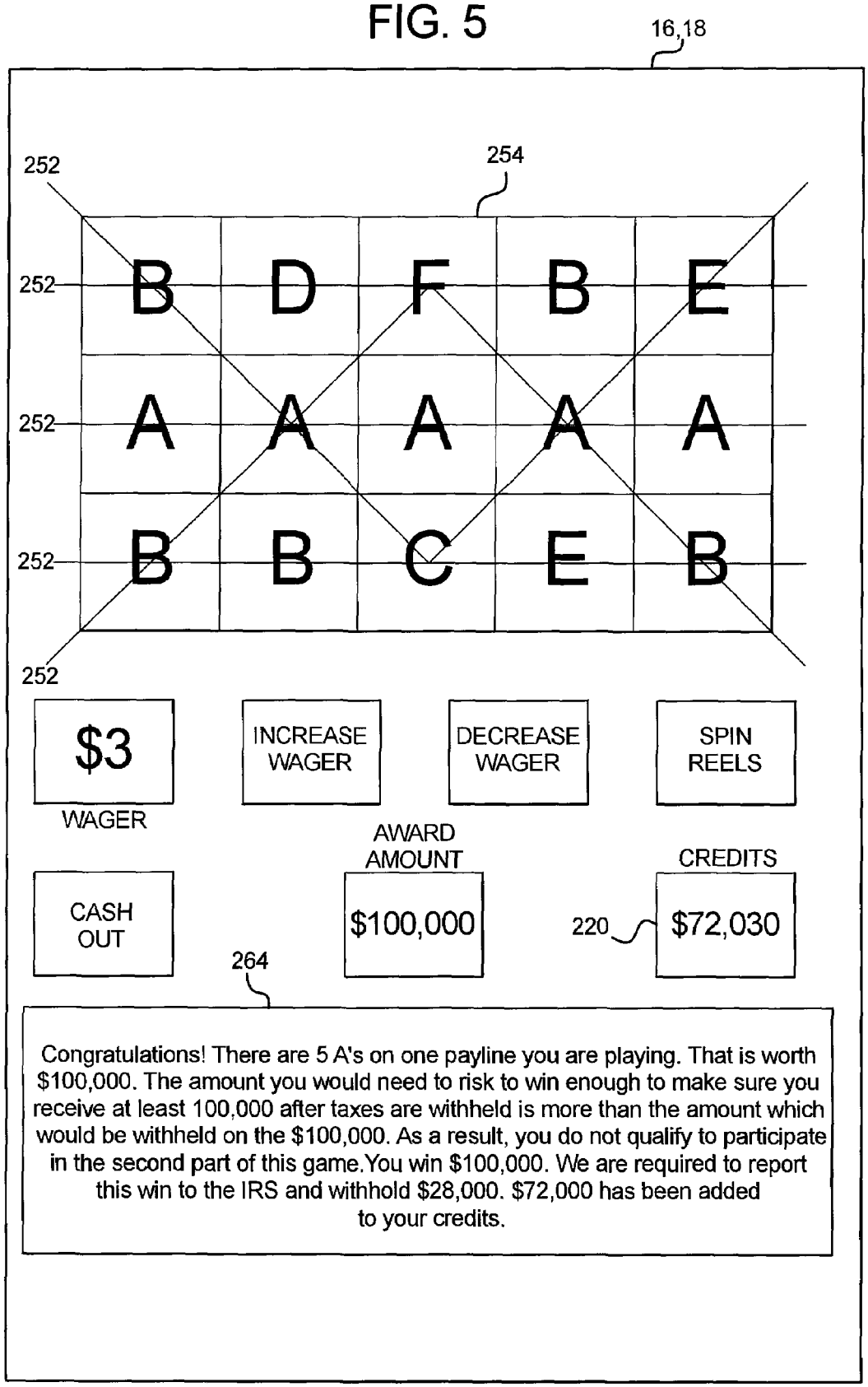
FIG. 5 is a block diagram of a display screen in accordance with one embodiment in which a player is not qualified to participate in a second part of a game if an award amount is greater than or equal to an upper threshold.

In the embodiment shown in FIG. 5, the gaming device includes an upper threshold. Specifically, the upper threshold is the award amount at which the minimum amount the player could risk in the second part of the game is more than the amount which would be withheld and/or reported on the award amount. In this embodiment, the upper threshold is $1667. An award of $1667 would require the player to risk $468, but the withholding and/or reporting amount would only be $467. If the award amount is greater than or equal to the upper threshold, the player does not qualify to participate in the second part of the game.

As explained in text area 264, an outcome on one of the paylines 252 on the reels 254 is associated with an award amount of $100,000, which exceeds the upper threshold. The player would need to risk under one event $98,801 but the withholding (and/or reporting) would only be $28,000 IRS tax schedule. Consequently, the gaming device does not enable the player to participate in the second part of the game. As a result, a tax withholding amount of $28,000 is withheld and reported, the remaining amount of $72,000 is added to the player's credits 220 (or paid in another suitable form), and the game ends. As stated above, in alternative embodiments not illustrated, the total award is paid to the player, the player must pay the tax, and a suitable report is provided to the appropriate taxing authority.

It should be noted that in various embodiments, there is no upper threshold. In different embodiments, the upper threshold has different values (e.g., an amount at which the potential gain is smaller than the amount risked, an amount at which the ratio of the amount risked to the withholding amount exceeds a percentage such as 50%, 75%, 200%, or any other percentage, or any other suitable amount). In different embodiments, the upper threshold is predetermined or determined in any other suitable manner.

Figure 6:
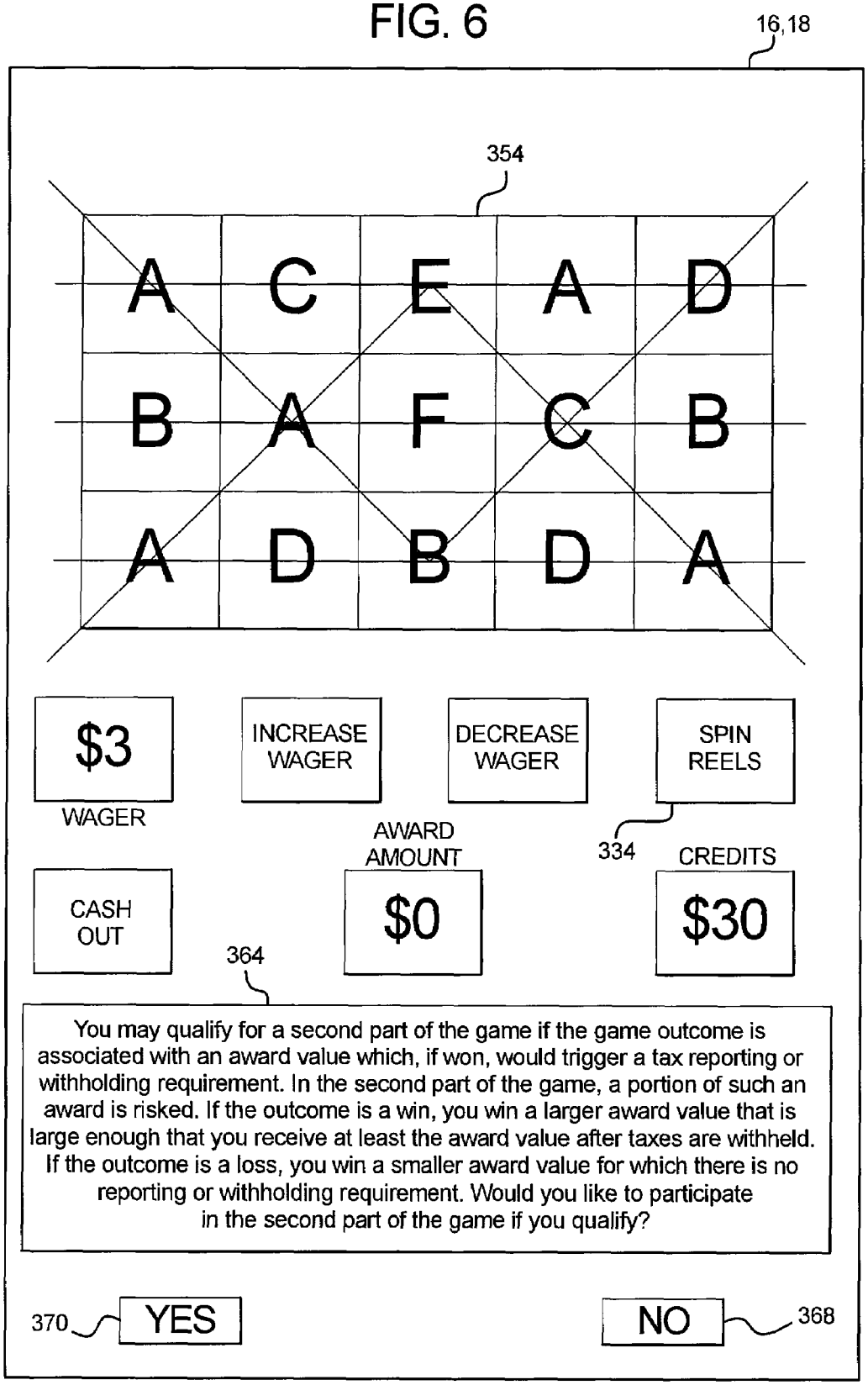
FIG. 6 is a block diagram of a display screen in accordance with one embodiment in which whether a player wishes to participate in a second part of a game is determined before it is determined whether the player qualifies to participate in the second part of the game.

In the embodiment shown in FIG. 6, the gaming device determines whether the player elects to participate in the second part of the game before the outcome of the first event is displayed. For example, before the first part of the game is played (i.e., before the player pushes the spin reels button 334 to activate the reels 354), the gaming device prompts the player in text area 364 to indicate whether the player wishes to proceed with the second part of the game if the player qualifies. If the player presses the yes button 370, the gaming device causes the player to participate in the second part of the game if the player qualifies. If the player presses the no button 368, the gaming device will not enable the player to participate in the second part of the game even if the player qualifies.

Figure 7:
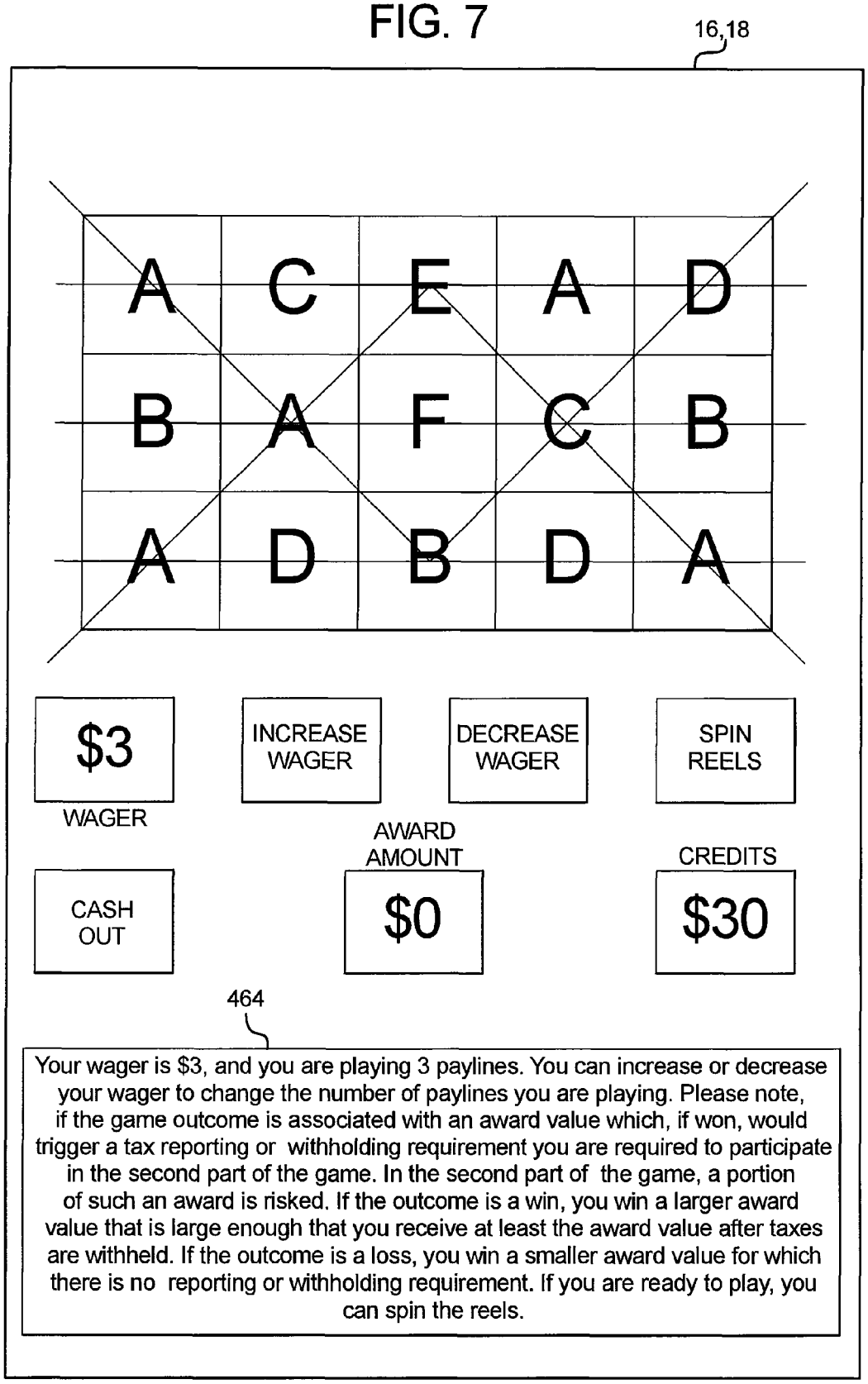
FIG. 7 is a block diagram of a display screen in accordance with one embodiment in which a player is required to participate in a second part of a game if the player qualifies.

In another embodiment, shown in FIG. 7, the gaming device requires the player to participate in the second part of the game if the player qualifies. As explained in text area 464, the player has no choice about participating in the second part of the game. If the player qualifies, the player will risk a portion of the award amount in the hopes of increasing the amount awarded enough that the player receives the award amount after tax is withheld. In different embodiments, the determination of whether the player is enabled to participate in the second part of the game is predetermined, randomly determined, determined based on a generated symbol or symbol combination, determined based on the player's status (obtained from a player tracking system), determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools, or determined based on any other suitable method or criteria.

It should be understood that different embodiments can have different tax threshold amounts. It should be further understood that in various embodiments, the processor is operable to receive data regarding the tax threshold amount from a remote server.

In one embodiment, the tax threshold amount is the maximum amount that can be provided to the player for that play of the game without triggering a withholding requirement. In another embodiment, the tax threshold amount is the maximum amount that can be provided to the player for that play of the game without triggering a reporting requirement. In this embodiment, at least one award amount triggers a reporting requirement without triggering a withholding requirement. If such an award amount is associated with the first game event, the amount that can be gained in the second part of the game by risking a portion of the award amount can be any suitable amount. For example, the gaming device prompts the player for the player's maximum or effective tax rate and calculates an amount which, if won, enables the player to receive the award amount after paying taxes on the increased amount. In another embodiment, the gaming device enables the player to select an amount which can be gained. The chance of a winning outcome is adjusted in accordance with the amount risked, the amount which can be gained, and the payout rate for the second event.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device storing a plurality of instructions, which when executed by the at least one processor, cause the at least one processor to operate with the at least one display device and the at least one input device to:

display a first event in a game, determine if a first award amount displayed to a player as a result of said first event in the game is greater than or equal to a tax threshold amount, if said first award amount is less than said tax threshold amount, cause said first award amount to be provided to the player, and if said first award amount is greater than or equal to said tax threshold amount:

(a) enable the player to proceed with a second event in the game wherein an excess amount is risked, said excess amount being greater than the difference between the first award amount and the tax threshold amount, (b) if the player does not proceed with the second event, cause said first award amount to be provided to the player and cause tax reporting data to be generated for submission to a taxing authority, and (c) if the player proceeds with the second event:

(i) determine an outcome for the second event at least in part based on the excess amount, (ii) if the outcome is a winning outcome, cause an increased award amount including the first award amount and a tax award amount to be provided to the player, said tax award amount including an amount needed to at least partially cover a tax amount on the first award amount, and (iii) if the outcome is a losing outcome, cause said first award amount less the excess amount to be provided to the player.

2. The gaming system of claim 1, wherein the tax threshold amount is a maximum amount that can be provided to the player for that play of the game without triggering a reporting requirement to the taxing authority.

3. The gaming system of claim 1, wherein data representing the amount of said tax threshold amount is received from a remote server.

4. The gaming system of claim 1, wherein the instructions, which when executed by the at least one processor, cause the at least one processor to operate with the at least one display device and the at least one input device to determine whether the player will proceed with the second event before the first event is displayed.

5. The gaming system of claim 1, wherein the instructions, which when executed by the at least one processor, cause the at least one processor to operate with the at least one display device to display a chance of the outcome being the winning outcome.

6. A gaming system comprising:

at least one display device;

at least one input device;

at least one processor; and at least one memory device storing a plurality of instructions, which when executed by the at least one processor, cause the at least one processor to operate with the at least one display device and the at least one input device to:

display a first event in the game, determine if a first award amount displayed to a player as a result of said first event in the game is greater than or equal to a tax threshold amount and less than a predefined upper threshold, if said first award amount is less than said tax threshold amount, cause said first award amount to be provided to the player, and if said first award amount is greater than or equal to said tax threshold amount and less than said predefined upper threshold:

(a) enable the player to proceed with a second event in the game wherein an excess amount is risked, said excess amount being greater than the difference between the first award amount and the tax threshold amount, (b) if the player does not proceed with the second event, cause said first award amount to be provided to the player and cause tax reporting data to be generated for submission to a taxing authority, and (c) if the player proceeds with the second event:

(i) determine an outcome for the second event at least in part based on the excess amount, (ii) if the outcome is a winning outcome, cause an increased award amount including the first award amount and a tax award amount to be provided to the player, said tax award amount including an amount needed to at least partially cover a tax amount on the first award amount, and (iii) if the outcome is a losing outcome, cause said first award amount less the excess amount to be provided to the player.

7. The gaming system of claim 6, wherein the tax threshold amount is a maximum amount that can be provided to the player for that play of the game without triggering a reporting requirement to the taxing authority.

8. A method of operating a gaming device, said method comprising:

displaying a first event in a game on a display device, causing a processor to determine if a first award amount displayed to a player as a result of said first event in the game is greater than or equal to a tax threshold amount, causing the processor to, if said first award amount is less than said tax threshold amount, cause said first award amount to be provided to the player, and causing the processor to, if said first award amount is greater than or equal to said tax threshold amount:

(a) enable the player to proceed with a second event in the game wherein an excess amount is risked, said excess amount being greater than the difference between the first award amount and the tax threshold amount, (b) if the player does not proceed with the second event, cause said first award amount to be provided to the player and cause tax reporting data to be generated for submission to a taxing authority, and (c) if the player proceeds with the second event:

(i) determine an outcome for the second event at least in part based on the excess amount, (ii) if the outcome is a winning outcome, cause an increased award amount including the first award amount and a tax award amount to be provided to the player, said tax award amount including an amount needed to at least partially cover a tax amount on the first award amount, and (iii) if the outcome is a losing outcome, cause said first award amount less the excess amount to be provided to the player.

9. The method of claim 8, wherein the tax threshold amount is a maximum amount that can be provided to the player for that play of the game without triggering a reporting requirement to the taxing authority.

10. The method of claim 8, which includes causing the processor to receive data representing the amount of said tax threshold amount from a remote server.

11. The method of claim 8, which includes causing the processor to determine whether the player will proceed with the second event before the first event is displayed.

12. The method of claim 8, which includes displaying a chance of the outcome being the winning outcome on the display device.

13. A method of operating a gaming device, said method comprising:

displaying a first event in the game on a display device, causing a processor to determine if a first award amount displayed to a player as a result of said first event in the game is greater than or equal to a tax threshold amount and less than a predefined upper threshold, causing the processor to, if said first award amount is less than said tax threshold amount, cause said first award amount to be provided to the player, and causing the processor to, if said first award amount is greater than or equal to said tax threshold amount and less than the upper threshold:

(a) enable the player to proceed with a second event in the game wherein an excess amount is risked, said excess amount being greater than the difference between the first award amount and the tax threshold amount, (b) if the player does not proceed with the second event, cause said first award amount to be provided to the player and cause tax reporting data to be generated for submission to a taxing authority, and (c) if the player proceeds with the second event:

(i) determine an outcome for the second event at least in part based on the excess amount, (ii) if the outcome is a winning outcome, cause an increased award amount including the first award amount and a tax award amount to be provided to the player, said tax award amount including an amount needed to at least partially cover a tax amount on the first award amount, and (iii) if the outcome is a losing outcome, cause said first award amount less the excess amount to be provided to the player.

14. The method of claim 13, wherein the tax threshold amount is a maximum amount that can be provided to the player for that play of the game without triggering a reporting requirement to the taxing authority.

15. A gaming system comprising:

at least one display device;

at least one input device;

at least one processor; and at least one memory device storing a plurality of instructions, which when executed by the at least one processor, cause the at least one processor to operate with the at least one display device and the at least one input device to:

display a first event in a game, determine if a first award amount displayed to a player as a result of said first event in the game is greater than or equal to a tax threshold amount, if said first award amount is less than said tax threshold amount, cause said first award amount to be provided to the player, and if said first award amount is greater than or equal to said tax threshold amount:

(a) enable the player to proceed with a second event in the game wherein an excess amount is risked, said excess amount being greater than the difference between the first award amount and the tax threshold amount, (b) enable the player to adjust the excess amount, (c) if the player does not proceed with the second event, cause said first award amount to be provided to the player and cause tax reporting data to be generated for submission to a taxing authority, and (d) if the player proceeds with the second event:

(i) determine an outcome for the second event at least in part based on the excess amount, (ii) if the outcome is a winning outcome, cause an increased award amount including the first award amount and a tax award amount to be provided to the player, said tax award amount including an amount needed to at least partially cover a tax amount on the first award amount, and (iii) if the outcome is a losing outcome, cause said first award amount less the excess amount to be provided to the player.

16. A method of operating a gaming device, said method comprising:

displaying a first event in a game on a display device, causing a processor to determine if a first award amount displayed to a player as a result of said first event in the game is greater than or equal to a tax threshold amount, causing the processor to, if said first award amount is less than said tax threshold amount, cause said first award amount to be provided to the player, and causing the processor to, if said first award amount is greater than or equal to said tax threshold amount:

(a) enable the player to proceed with a second event in the game wherein an excess amount is risked, said excess amount being greater than the difference between the first award amount and the tax threshold amount, (b) enable the player to adjust the excess amount, (c) if the player does not proceed with the second event, cause said first award amount to be provided to the player and cause tax reporting data to be generated for submission to a taxing authority, and (d) if the player proceeds with the second event:

(i) determine an outcome for the second event at least in part based on the excess amount, (ii) if the outcome is a winning outcome, cause an increased award amount including the first award amount and a tax award amount to be provided to the player, said tax award amount including an amount needed to at least partially cover a tax amount on the first award amount, and (iii) if the outcome is a losing outcome, cause said first award amount less the excess amount to be provided to the player.

* * * * *

UNITED STATES PATENT AND TRADEMARK OFFICE

CERTIFICATE OF CORRECTION

PATENT NO. : 7,963,842 B2
APPLICATION NO. : 11/876294
DATED : June 21, 2011
INVENTOR(S) : Robert W. Ruymann It is certified that error appears in the above-identified patent and that said Letters Patent is hereby corrected as shown below:

Claim 2, column 25, line 1, replace “that” with --a--.

Claim 4, column 25, line 6, between “the” and “instructions,” add --plurality of--.

Claim 4, column 25, line 7, delete “which”.

Claim 5, column 25, line 12, between “the” and “instructions,” add --plurality of--.

Claim 5, column 25, line 13, delete “which”.

Claim 6, column 25, line 26, replace “the” with --a--.

Claim 7, column 25, line 60, replace “that” with --a--.

Claim 9, column 26, line 29, replace “that” with --a--.

Claim 13, column 26, line 43, replace “the” with --a--.

Claim 14, column 27, line 9, replace “that” with --a--.

Signed and Sealed this
Twenty-first Day of August, 2012

David J. Kappos

David J. Kappos
*Director of the United States Patent and Trademark Office*